United States Patent [19]

Wagner

[11] 4,215,495

[45] Aug. 5, 1980

[54] ROAD GRADE ATTACHMENT

[76] Inventor: Donald G. Wagner, 200 N. El Camino Real #7, Oceanside, Calif. 92054

[21] Appl. No.: 941,487

[22] Filed: Sep. 11, 1978

[51] Int. Cl.[2] ..... E02F 5/00

[52] U.S. Cl. ..... 37/109; 172/26; 172/783; 172/239; 404/86

[58] Field of Search ..... 37/108–110; 172/26, 783, 796, 797, 239, 387, 392, 393; 404/83, 84, 86, 104

[56] References Cited

U.S. PATENT DOCUMENTS

| | | | |
|---|---|---|---|
| 3,127,689 | 4/1964 | Hopkins | 172/783 X |
| 3,236,163 | 2/1966 | Ackerman et al. | 404/84 |
| 3,266,050 | 8/1966 | Reeder | 172/797 X |
| 3,786,871 | 1/1974 | Long et al. | 37/108 R |
| 4,125,950 | 11/1978 | Mashford | 172/387 X |

*Primary Examiner*—E. H. Eickholt

*Attorney, Agent, or Firm*—Whann & McManigal

[57] ABSTRACT

My invention consists of an attachment adapted to be connected to a road grader blade. It has a mounting means in the form of a frame for attachment to the blade, a support carried by said mounting means which in turn carries a curb shoe, the support being capable of being raised or lowered in order to position the blade in the proper horizontal plane. The vertically adjustable support carries a universal joint and the universal joint in turn carries a curb shoe which consists of an element having a relatively flat surface which engages a surface of the curb.

5 Claims, 4 Drawing Figures

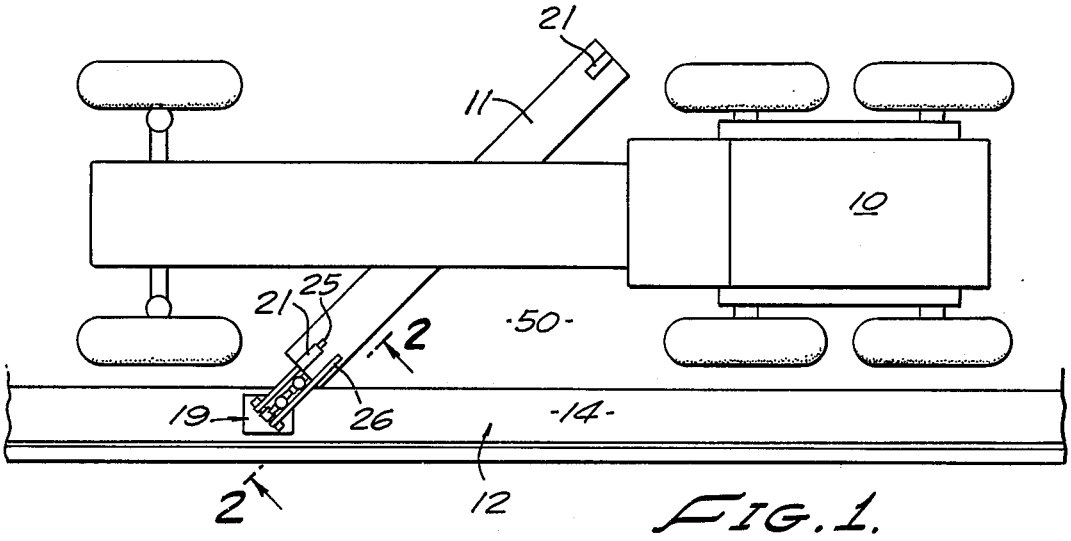
FIG. 1.
FIG. 2.
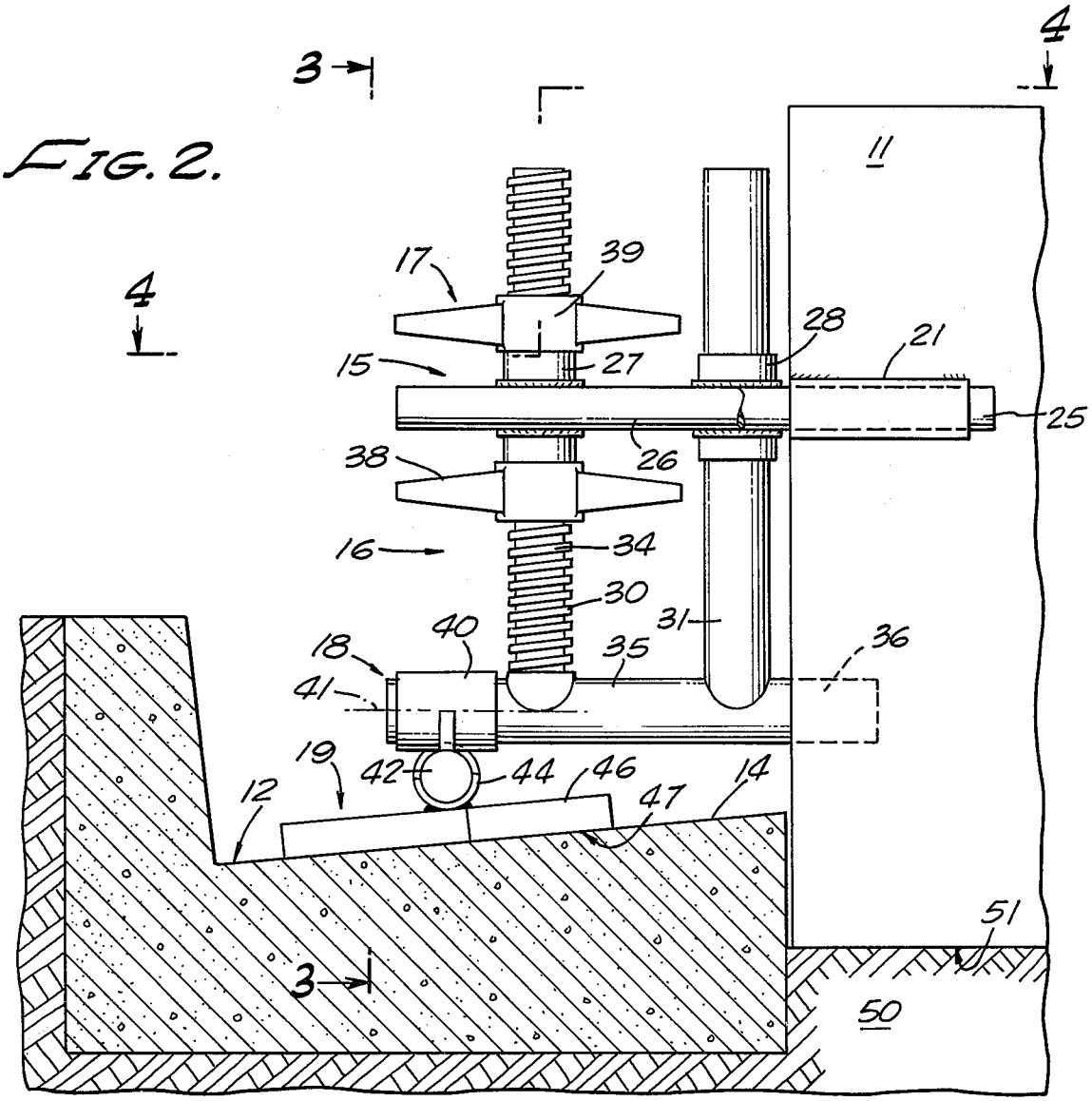

ROAD GRADE ATTACHMENT

BACKGROUND OF THE INVENTION

In the laying of a road, it is common practise to first pour the cement curb along the side of the road and to thereafter by means of the blade scraper to scrape the road bed surface at a proper depth with respect to the top surface of the curb. The attachments or devices with which applicant is familiar include frame structures adapted to be attached to the blade by bolts and the curb engaging element is in the form of a wheel which rides on the top surface of the curb. There is, of course, adjustable means whereby the wheel which rides or rolls on the curb may be raised or lowered relative to the blade in order that the cutting edge of the blade may be positioned where desired.

These attachments are cumbersome to handle. Time is required to bolt and unbolt and adjust the parts so that they will be in the right positions and operate satisfactorily. The structures with which applicant is familiar are shown in the Patent to Hopkins, U.S. Pat. No. 3,127,689, granted Apr. 7, 1964, and the Patent to Reeder U.S. Pat. No. 3,266,050 granted Aug. 6, 1966.

SUMMARY OF THE INVENTION

The attachment of my invention is of simple, sturdy construction. It is easy to mount on the grader blade at either end thereof and includes a curb shoe which has a relatively large flat surface which engages a surface of the curb.

It is an object of my invention to provide a device of the class described which is simple to mount on the scraper blade and which does not require any attachment bolts; but is held in place by sliding certain parts together, and then when the structure is in operation, pressure applied as a result of forward movement of the blade holds the attachment in operating position.

It is an object of my invention to provide such a depth gauge which can be mounted on either end of the scraper or grader blade.

It is a further object of my invention to provide the curb shoe, previously referred to, which rides along the curb surface and cleans its own path on the curb or concrete or hard surface and therefore will always cut a true grade.

It is also an object of my invention to provide a device of the class described which will not damage the curb or any concrete surface over which it is operating.

It is also an object of my invention to provide a blade depth gauge attachment which has a wide range of positions so that the blade may cut up to a depth of 18 inches or so or can be lowered to such an extent that the cut can be in such a position that it can be used to lay black top above the curb grade.

Other objects of the invention will be made evident during the course of the following detailed description of the preferred form of my invention.

BRIEF DESCRIPTION OF THE DRAWINGS

FIG. 1 is a plane view highly diagramatic which illustrates a grader having a blade with the attachment of my invention attached to one end thereof.

FIG. 2 is a view showing the attachment of my invention mounted on the end of the grader blade, the view being taken from the rear of the blade and looking in a forward direction.

Referring to FIG. 1, the numeral 10 very diagramatically illustrates the grader, which grader has a blade 11 which is usually positioned at an angle of approximately 45° as shown. The details of the means for positioning the blade 11 form no part of the present invention and therefore are not shown. It should be understood, however, that so far as the grader 10 is concerned, it can be any standard type of grader that is now in common use.

FIG. 1 shows a curb 12 having an upper surface 14 on which the attachment of my invention rides. The attachment in FIG. 1 is shown in place and is mounted on the end of the blade 11 and rides on the surface 14.

Figure 3:
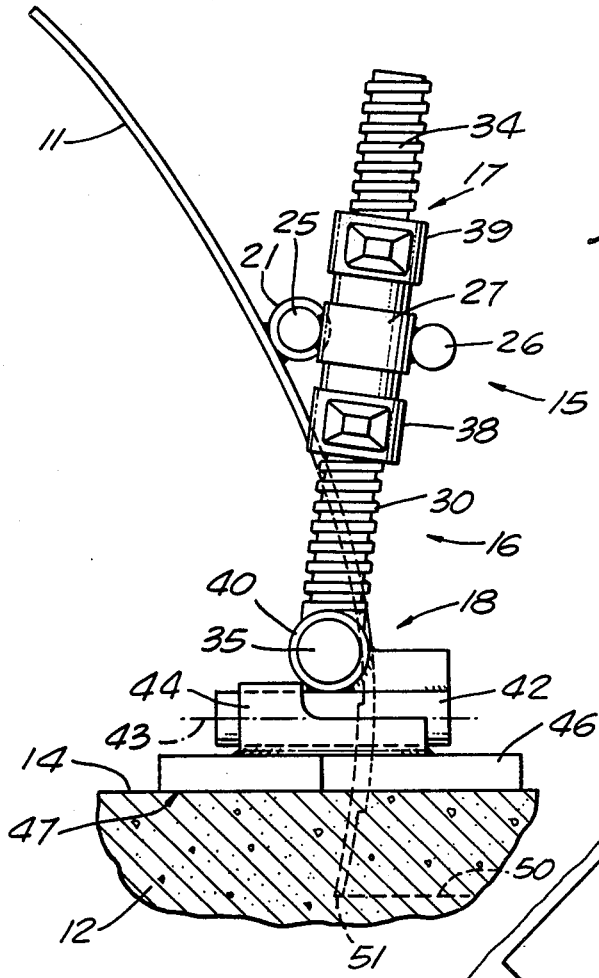
FIG. 3 is an elevational view taken on the line 3—3 and looking in the directon of the arrows 3—3.

Broadly stated, my attachment includes a mounting means in the form of a frame 15 which is adapted for mounting on the blade 11 with the attachment positioned adjacent to the end of the blade. The mounting means 15 carries a vertically adjustable curb shoe carrying structure 16 having adjusting means 17 whereby the supporting structure may be raised or lowered. The supporting structure carries a universal joint 18 which in turn carries the curb shoe 19 which rides on the curb surface 14.

The details of construction of my invention will now be described.

A support element 21 is mounted on the rear surface at each end of the blade 11. This support element is preferably in the form of a horizontally positioned tubular member and is preferably welded to the rear surface of the blade 11.

Figure 4:
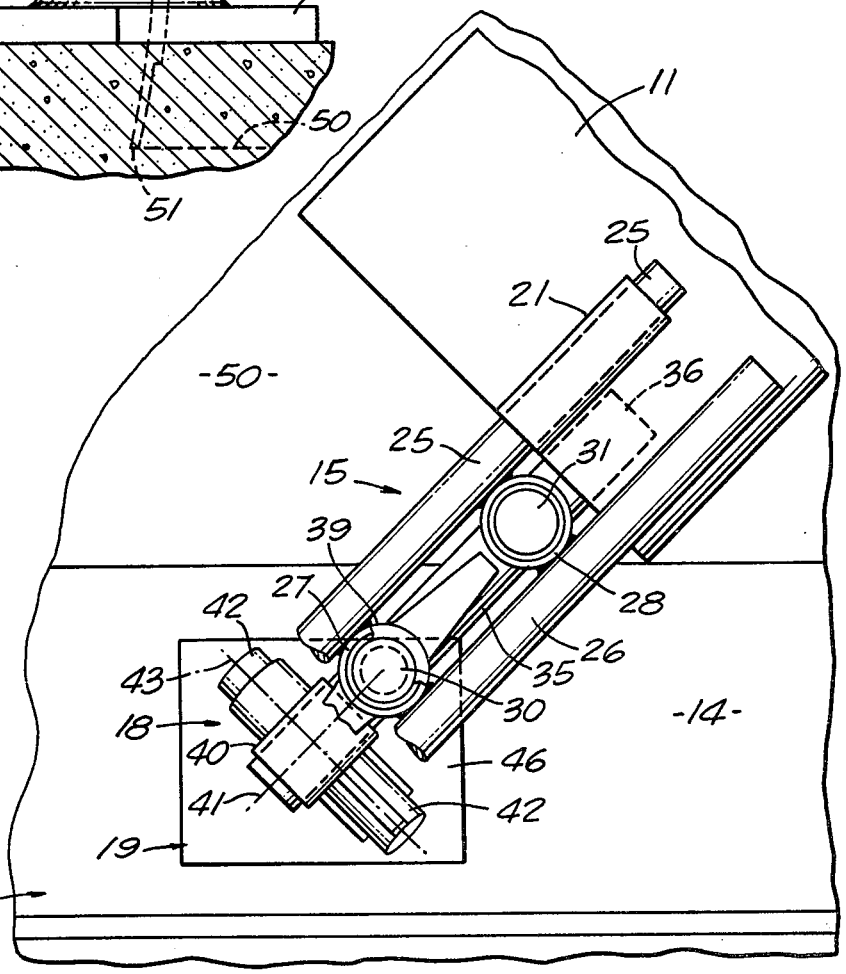
FIG. 4 is a plan view taken on the line 4—4 of FIG. 2 and looking downwardly in the directions of the arrow 4—4.

The mounting frame 15, as best shown in FIG. 4, comprises two horizontal cylindrical bars 25 and 26 horizontally spaced apart and includes sleeves 27 and 28 which are mounted in a vertical position. In this application, where the term vertical or horizontal is used, it is understood that these terms refer only in general to vertical and horizontal directions. For example, the parts might be precisely vertical or horizontal or at angles to vertical or horizontal, depending upon the particular position of the blade 11.

In the drawings, the bar 25 is shown as extending through the sleeve 21 positioned at the end of the blade 11. The bar 25 and interior of the sleeve 21 are a sliding fit so that when the attachment is being mounted on the blade the end of the bar 25 is extended into the opening of the sleeve and the entire attachment is then moved horizontally toward the blade so that the parts will rest in the positions shown in the drawings.

Because applicant's invention is adapted to be mounted on either end of the grader blade, there is the second bar 26, which when the attachment is used at the opposite end of the blade would extend into the sleeve 21 at that opposite end of the blade.

The vertically adjustable shoe carrying structure 16, as shown best in FIG. 2, is provided with two substantially vertical parallel bars or rods 30 and 31 which extend through the sleeves 27 and 28 column. This element is vertically adjustable, the substantially vertical bars moving through the sleeves 27 and 28. It will be noted that the rod 31 which is cylindrical has a smooth outer surface which is a sliding fit with the sleeve 28; and that the rod 30 is threaded as indicated at 34.

The rods or bars 30 and 31 extend upwardly from a horizontal element on bar 35; an end of the bar 35, indicated by the dotted lines 36, extends past the end of the blade and is engageable with the forward surface of the blade as shown in FIG. 3 and also by the dotted lines 36 in FIG. 4.

The adjusting means 17 of my invention comprise winged nuts 38 and 39 threaded onto the bar or shaft 30 above and below the sleeve 27. By rotating the nuts 38 and 39, the entire frame may be raised or lowered with respect to the mounting frame 15. When the nuts are tightened in place the two parts are secured together and a rigid structure is provided.

Supported on the vertically adjustable frame 16 is a universal joint 18 comprising a sleeve 40 mounted on the outer end of the cylindrical rod 35, the sleeve 40 being rotatable on the axis 41. Attached to and positioned below the sleeve 40 is a cylindrical rod 42 which is positioned on the axis 43, the axes 41 and 43 extending at right angles to each other as shown in FIG. 4. Positioned on the rod 42 is a sleeve 44 which is adapted to rotate on the rod 42 and on the axis 43.

Rotational parts rotating on these two axes 41 and 43 provide the universal joint of my invention.

Curb shoe 46 is, in the form of my invention shown, a rectangular plate having a lower flat surface 47 which engages the surface 14 of the curb 12. Connected to the curb shoe 46 is the sleeve 44, this being accomplished preferably by welding. Because of the universal joint, the surface 47 always lies flat on the surface 14.

The operation of my invention is substantially as follows:

To install the gauging attachment, it is best to raise the blade 11 into an elevated position for easy access. The attachment is then positioned with the bar 25 in alignment with the sleeve 21; the attachment is then moved toward the end of the blade so that the parts are in the position shown in the drawings. It will be noted that the vertical bars 30 and 31 are slightly tilted from a precise vertical position so that the bar 35 is forwardly of the blade and the end 36 engages the forward surface of the blade.

At this time the vertically adjustable frame is then adjusted into its approximate position and this is done by operating the winged nuts 38 and 39 as required. The blade is then lowered until the curb shoe 46 engages the surface 14 of the curb. If the cutting edge of the blade 51 is in its proper position to grade the surface of the bed 50, then no further adjustment is necessary. However, if the position is not exact, the operator then by manipulating the winged nuts 38 and 39 moves the vertically adjustable frame so that the curb shoe is in a proper position to hold the cutting edge 31 exactly where it should be.

In using the apparatus, the grader is moved in a forward direction which is to the left in FIG. 1. Because the shoe 46 is resting on the surface 14, there is a resistance which tends to hold the lower part of the attachment from forward movement. If the end 36 of the rod 35 is not in engagement with the forward surface of the blade, the entire attachment will rotate in the sleeve 21 and on the axis of the cylindrical bar 25. This brings the end 36 of of the bar 35 into pressural engagement with the forward surface of the blade, and therefore as the structure moves forwardly the attachment is held securely in place.

The lower surface 47 of the curb shoe 46 is in pressural engagement with the surface 14 of the curb and rides along that smooth surface supporting the blade 15 so that the cutting edge 11 grades the roadbed or surface of 50 at the proper level. Because of the area of the surface 46 of the shoe and because of its pressural contact with the surface 14, any material which may be resting on the surface 14 is moved out of the way and the shoe moves smoothly along the surface of the curb.

The universal joint functions to allow the surface 47 to closely adhere to the surface 14 and follow it precisely throughout the forward movement of the grader.

If it is desired to position the depth gauge attachment to the opposite end of the grader, this is done by following the process heretofore described except that in positioning the attachment at the opposite end of the blade 11, it is the rod 26 which is extended through the sleeve 21 at that opposite end of the blade.

I claim:

1. In combination with a grader blade of the road grader, a blade support means comprising:

(a) a mounting frame for mounting said blade support means on or at the end of a blade comprising a pair of parallel rods extending substantially horizontally and a pair of sleeves positioned between said rods;

(b) a vertically movable frame consisting of two substantially vertically extending bars which project through said sleeves and a horizontally extending bar at the lower ends of said vertically extending bars, said horizontally extending bar having an end portion adapted to engage the forward surface of said blade;

(c) a universal joint positioned on said horizontal bar of said vertically movable frame; and (d) a curb shoe having a lower surface adapted to engage a surface of the curbing along the side of said roadway, said curb shoe being supported by said universal joint, said universal joint permitting said curb shoe to slide along said curbing surface in sliding contact therewith.

2. A combination as defined in claim 1, in which:

(a) there is a vertically adjusting means for vertically adjusting said vertically movable frame comprising the threads formed on one of said substantially vertical rods and a nut means positioned on opposite sides of the sleeve through which said threaded rod extends for clamping said threaded rod in the desired position with respect to said mounting frame.

3. In combination with a grader blade of a road grader, a blade support means comprising:

a. mounting means for mounting said blade support means at the end of said blade;

b. said mounting means including a hollow element mounting on said blade, with an extension of said mounting frame extending into said hollow element;

c. a vertically movable curb shoe carrying means vertically adjustable on said mounting means, said vertically adjustable curb shoe carrying means having a portion which is held in engagement with the forward surface of the blade when the grader is moving in a forward direction; and d. a curb shoe having a relatively flat surface engageable with a surface of a curb positioned along the side of the road being made and a universal joint means connecting said curb shoe with said vertically movable carrying means.

4. In combination with a grader blade of a road grader, a blade support means comprising:

a. mounting means for mounting said blade support means at an end of said blade;

b. a vertically movable curb shoe carrying means vertically adjustable on said mounting means, and including a horizontally extending member projecting outwardly from the end of said blade;

c. a self-adjusting universal joint positioned on said horizontally extending member outwardly of the end of said blade; and d. a curb shoe having a lower surface adapted to engage a surface of the curbing along the side of said roadway, said curb shoe being supported by said universal joint, said universal joint permitting said curb shoe to slide along said curbing surface in adjustable sliding-contact therewith.

5. A combination as defined in claim 4 in which there is a single self-adjusting universal joint connecting the curb shoe to the horizontally extending member.

* * * * *